US006698067B2

(12) United States Patent
Strange et al.

(10) Patent No.: US 6,698,067 B2
(45) Date of Patent: Mar. 2, 2004

(54) LOCKING STRAP WITH HANDLING STRUCTURE

(75) Inventors: Andrew Strange, Collierville, TN (US); Kimberly Van Horn, Memphis, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 10/060,570

(22) Filed: Jan. 30, 2002

(65) Prior Publication Data

US 2003/0140459 A1 Jul. 31, 2003

(51) Int. Cl.[7] ..... B65D 63/00
(52) U.S. Cl. ..... 24/16 PB; 24/30.5 P
(58) Field of Search ..... 24/16 PB, 17 AP, 24/16 R, 30.5 P, 30.5 R

(56) References Cited

U.S. PATENT DOCUMENTS

| | | | | | |
|---|---|---|---|---|---|
| 1,522,836 | A | | 1/1925 | Rawl | |
| 3,206,813 | A | | 9/1965 | Schumm | |
| 3,438,095 | A | * | 4/1969 | Evans | |
| 3,556,575 | A | * | 1/1971 | Farkas | |
| 3,855,670 | A | * | 12/1974 | Brudy | 24/16 PB |
| 3,953,911 | A | | 5/1976 | Fishack | |
| 3,973,610 | A | * | 8/1976 | Ballin | 383/71 |
| 4,028,777 | A | * | 6/1977 | Schobel et al. | 24/16 PB |
| 4,077,562 | A | * | 3/1978 | Ballin | 383/71 |
| 4,227,668 | A | | 10/1980 | Ernst | |
| 4,480,357 | A | * | 11/1984 | Cummins | 24/90.1 |
| 4,501,354 | A | | 2/1985 | Hoffman | |
| 4,570,303 | A | | 2/1986 | Richmond et al. | |
| 4,676,535 | A | | 6/1987 | Mautner | |
| 4,901,403 | A | * | 2/1990 | Larsen | 24/16 PB |
| 5,123,913 | A | | 6/1992 | Wilk et al. | |
| 5,193,254 | A | | 3/1993 | Geisinger | |
| 5,317,787 | A | | 6/1994 | Fortsch | |
| 5,396,684 | A | * | 3/1995 | Yocom | 24/16 PB |
| 5,531,733 | A | | 7/1996 | Scarrow | |
| 5,799,376 | A | * | 9/1998 | Harsley | 24/16 PB |
| 6,185,791 | B1 | | 2/2001 | Khokhar | |
| 6,186,451 | B1 | | 2/2001 | Benoit | |
| 6,235,987 | B1 | | 5/2001 | Gamaggio-Schafer | |

* cited by examiner

*Primary Examiner*—Robert J. Sandy
(74) *Attorney, Agent, or Firm*—Hoffman & Baron, LLP

(57) ABSTRACT

A locking strap comprises a resilient finger grasp for facilitating assembly of the locking strap around one or more articles. The locking strap includes an elongate member at one end, a tail at the other end, and a central flexible strap body therebetween. A resilient finger grasp is located between the tail and the central strap body and facilitates fastening of the locking strap.

3 Claims, 5 Drawing Sheets

LOCKING STRAP WITH HANDLING STRUCTURE

FIELD OF THE INVENTION

The present invention relates to locking straps. More particularly, the present invention relates to a locking strap having structural features which permit the locking strap to be more easily grasped to thereby provide a more efficient locking mechanism.

BACKGROUND OF THE INVENTION

Locking straps have long been used for a variety of functions. Some applications include the use as cable ties for assembling or bundling electrical wires or cables, as handcuffs, or for other purposes of bundling together or fastening items. Locking straps typically include an elongate member having a head at one end, a tail at the other end, and a longitudinal strap lying therebetween. The locking strap is used by wrapping the strap around a bundle of articles and inserting the tail through the head. The head and the body include cooperative looking elements so that when the tail is pulled tightly through the head, the locking elements secure the strap body in the head.

It is often difficult, however, to manually assemble the cooperative locking elements together, i.e., to pull the tail through the locking head. It is difficult to pull the tail through the head using the tail end of the strap because the strap at this point is not only relatively thin but the sparse amount of tail material makes it difficult for a user to grasp the tail. There is a tendency also for the tail to slip out from between the user's fingers making handling of the tie difficult. Furthermore, because a large insertion force is usually necessary to assemble the locking strap, it often leads to troublesome handling and the assembly is frequently less efficient and time consuming.

There have been several attempts to facilitate the fastening procedure for locking straps by providing a locking strap with a more grippable tail. U.S. Pat. No. 5,317,787 to Fortsch provides a cable tie with the head and tail including cooperative holding means for removably holding the tail in the head passage. The tail of the cable tie includes a plurality of tactile gripping elements extending from the surface of the tail. The gripping elements are extended, rounded elements which are positioned at spaced apart locations along a longitudinal edge of the surface of the tail. The tail, however, is still difficult to grip and pull through the head for locking of the cable tie.

U.S. Pat. No. 5,193,254 to Geisinger discloses a cable tie used as a handcuff which was designed to increase the ease of the assembly of the cable tie. A loop is provided near the tail of the cable tie, but the loop is not resiliently deformable, and was not designed for insertion of a finger therein. Because of the large insertion force typically necessary for the handcuffs, the cable tie is inefficient in the assembling thereof.

U.S. Pat. No. 4,676,535 to Mautner discloses a security seal with a locking strap near the tail end of the tie. The locking strap however, is not used to pull the tail end through the locking mechanism. The locking strap of Mautner has a fixed end and a free end retained within a slot in the security seal. The locking strap is retained in a slot within the tail during the assembly process. After the seal is assembled, the locking strap is pulled so that the free end moves longitudinally through the slot in the locking seal's body. The locking strap is further designed with a weakened section which breaks off the cable tie after the above-mentioned movement has taken place. This is done so that the cable tie cannot be tampered with; i.e., thereby locking the tail end of the strap in the head.

It is desirable, therefore, to provide a locking strap with features useful in readily pulling the strap through the head of the tail. It is also desirous to provide a cable tie with a grasping mechanism near its tail to make grasping the tail easier.

SUMMARY OF THE INVENTION

The present invention relates to a flexible locking strap for tightening around one or more articles. The flexible locking strap is formed of an elongate member having a head at one end, a tail at the other end, and a central flexible strap body therebetween. The head of the strap has a passage therethrough for receipt of the tail. The head and the body of the flexible locking strap include cooperative locking members for locking said body within said head passage. The locking strap has a resilient finger grasp located between the tail and the central strap body, the grasp being configured to pass through said head passage and resiliently deform therewithin. After passage through the head passage, the finger grasp resumes its previous shape and thereby facilitates grasping and pulling the strap body tightly around articles.

A method of fastening a flexible locking strap is also disclosed in the present invention. The method comprises the steps of providing an elongate member having a head at one end, a tail at another end, and a central flexible strap body therebetween. The head contains a passage therethrough for receipt of the tail. The head and the central flexible strap body contain cooperative locking members for locking the body within the head passage. During the fastening process the tail is inserted through the passage in the head. The tail contains a resilient finger grasp located between the tail and the central strap body. The finger grasp resiliently deforms within the head passage and resumes its original expanded shape after insertion through the passage. The expanded shape facilitates grasping and pulling the strap body through the head passage in order to integrally dispose cooperative locking members on said body and within said head passage.

In another embodiment of the present invention a flexible locking strap for tightening around one or more articles is provided. The flexible strap has an elongate member having a head at one end, a tail at the other end and a central flexible strap body therebetween. The head has a passage therethrough for receipt of the tail. The head and the body include a cooperative locking member for locking the body within the head passage. A flexible pulling tab is also located between said tail and said central strap body, the flexible tab being in cantilevered attachment with the flexible locking strap. The flexible pulling tab is adapted for pulling the strap body through the head passage.

In a further embodiment of the present invention a further flexible locking strap is provided. The flexible locking strap includes and elongate member having a head at one end, a tail at the other end, and a central flexible strap body therebetween. The head has a passage therethrough for receipt of the tail. The head and the body include cooperative locking members for locking the body within the head passage. A finger loop is located between the tail and the central strap body, the finger loop being resiliently deformable.

DETAILED DESCRIPTION OF THE INVENTION

Figure 1:
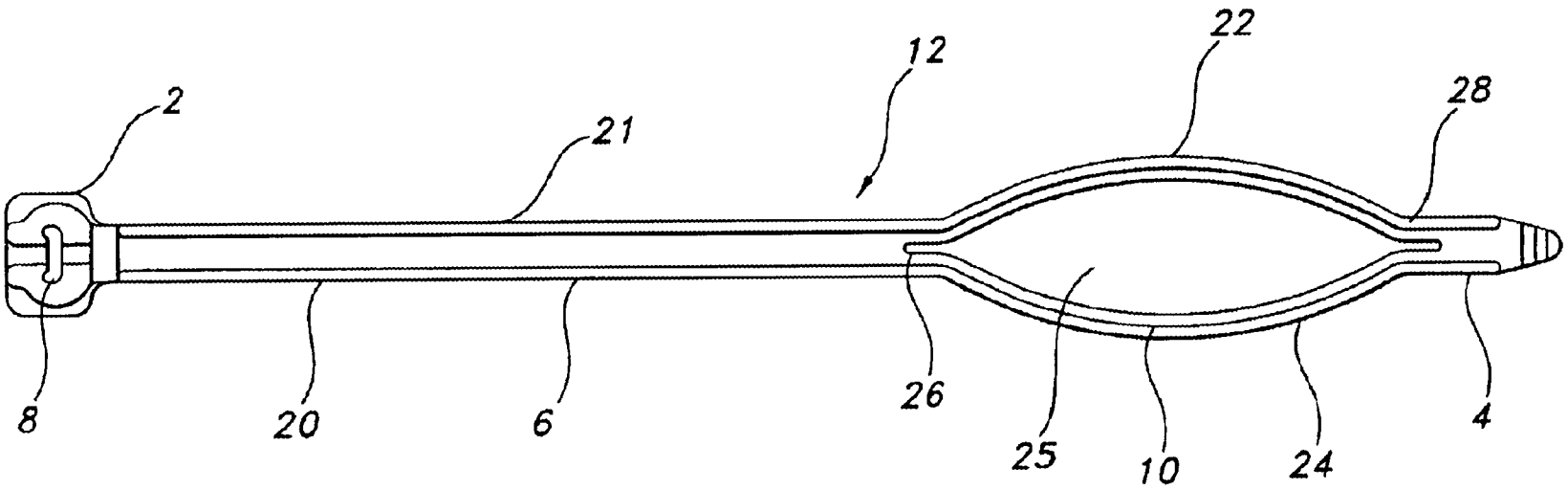
FIG. 1 is a top plan view of a representative locking strap with handling structure embodying features of the present invention.

Referring to the drawings, FIG. 1 shows a locking strap with handling structure in accordance with one arrangement of the present invention. The flexible locking strap 12 includes an elongate member having a head 2 at one end, a tail 4 at the other end, and a central flexible strap body 6 therebetween. The head 2 of the strap has a passage 8 therethrough for receipt of the tail 4. The head 2 and the body 6 of the flexible locking strap 12 include cooperative locking members, as will be described, for locking the body within the head passage 8. The locking strap 12 has a resilient finger grasp 10 located between the tail 4 and the central strap body 6, the grasp 10 being configured to pass through the head passage 8 and resiliently deform therethrough. After passage through the head passage 8, the finger grasp 10 resumes its previous shape and thereby facilitates grasping and pulling the strap body tightly around articles. Locking strap 12 is preferably integrally molded from a suitable synthetic organic plastic resin, such as polyamide resin, which possesses sufficient strength and resiliency to permit the desired working thereof, as well as the desired latching and release. Other materials having the desired properties may also be used.

Figure 2:
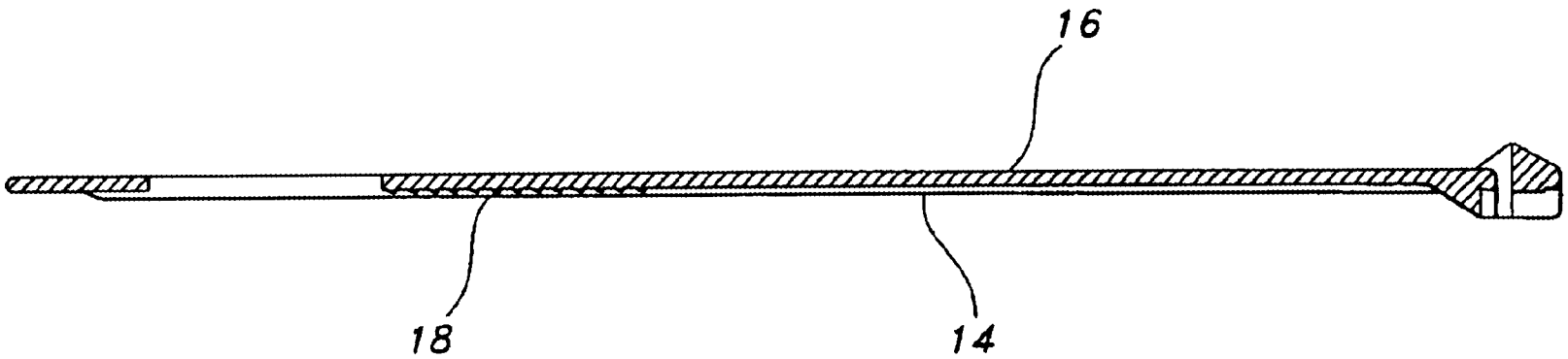
FIG. 2 is a side elevational view of the locking strap of FIG. 1.

FIG. 2 shows a side elevational view of a locking strap 12 of FIG. 1. Locking strap 12 is typically planar having a first major planar surface 14 and an opposed second major planar surface 16 and is formed in any desired length necessary to encompass the diameter of the object or objects to be fastened. The first planar surface 14 includes a plurality of transversely extending locking teeth 18 which are longitudinally spaced along the length of strap body 6. When the locking strap 12 is in a locked position, the first major surface 14 is generally oriented toward the objects to be fastened, being bundled so that the teeth 18 may serve to enhance the grip upon the objects being bundled. It should be appreciated, however, that the locking strap may be oriented with first major surface 14 in the opposite direction.

First and second planar surfaces 14, 16 are connected, as shown in FIG. 1, by transverse sidewalls 20, 21 which form planes which are substantially parallel to each other. As can also be seen in FIG. 1, resilient finger grasp 10 is formed of two spaced apart strap portions 22 and 24 which separate at a far end 26 of the central strap body 6 and then reunite at strap portion 28 adjacent tail 4. Strap portions 22 and 24 lie within the height of the strap defined by planer surfaces 14 and 16 and extend exteriorly laterally of the planes created by sidewalls 20, 21 forming an opening 25 of sufficient size for receipt of a finger therein. The grasp 10 will resiliently deform to be substantially coplanar with the planes formed by sidewalls 20, 21 when the grasp 10 is pushed through central passage 8 in the head of the locking strap 12. Once the finger grasp 10 has been inserted through the passage 8 however, finger grasp 10 resiliently expands to resume its former shape in order to assist assembly of the locking strap 12 by allowing insertion of a finger therein.

Figure 11:
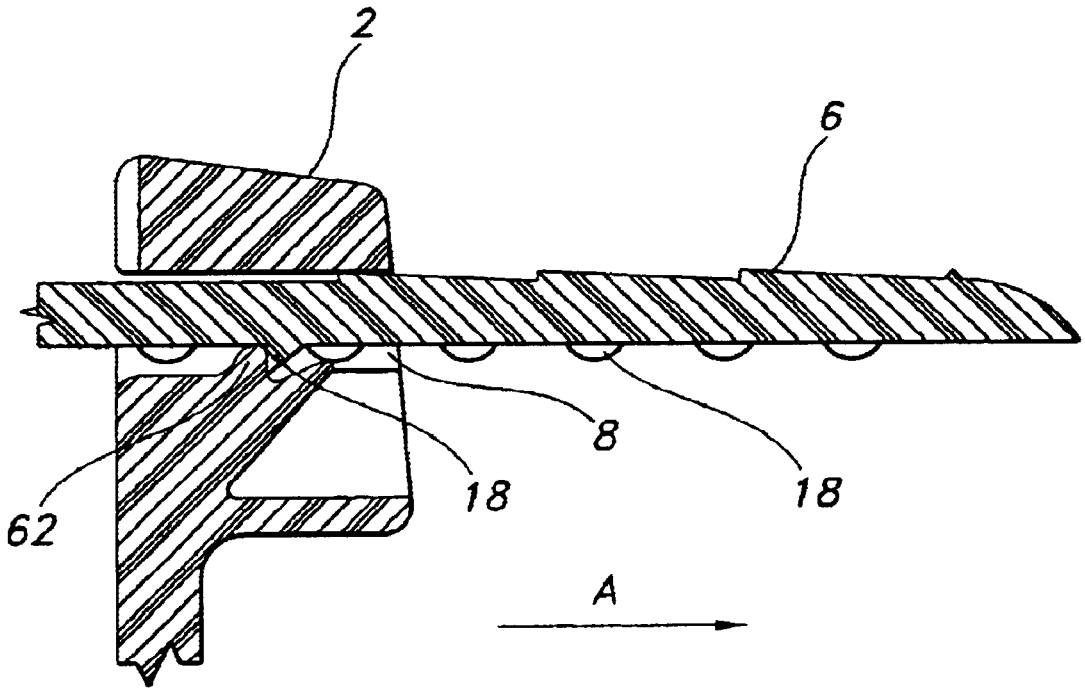
FIG. 11 is a partial cross-sectional view of an interlocking head and strap body of the present invention.

As can be seen in FIG. 2, transversely extending locking teeth 18 project outwardly from the planar surface of first planar surface 14. Locking teeth 18 are formed and mated to locking teeth 62 within head passage 8 (shown in FIG. 11) which are complementarily formed. When assembled, the respective locking teeth 18, 62 on the strap 12 and in the head 2 interlock to provide a mated locking relation.

Figure 4:
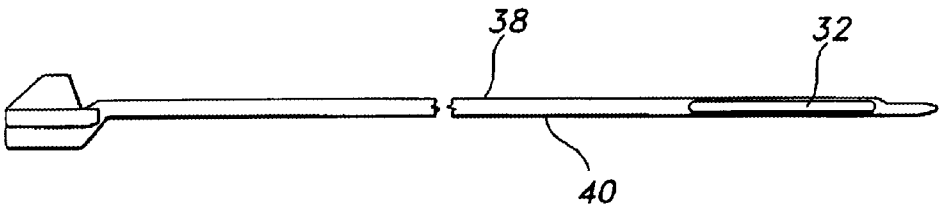
FIG. 4 is a side elevational view of the locking strap of FIG. 3.
Figure 3:
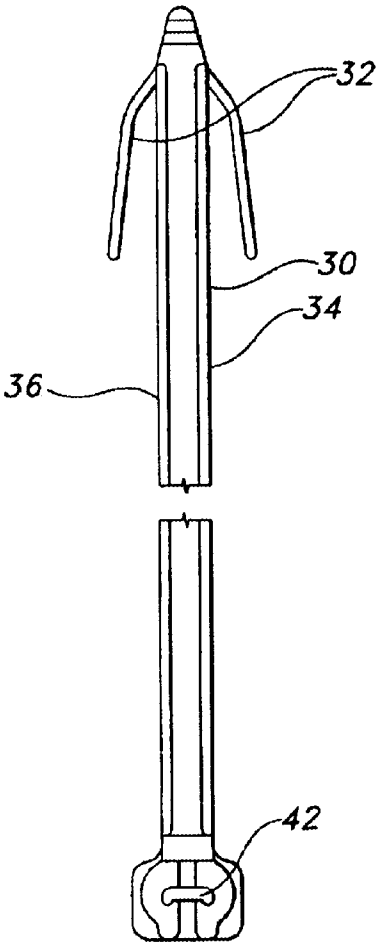
FIG. 3 is a top plan view of another embodiment of a locking strap of the present invention.

FIGS. 3 and 4 show another embodiment of a locking strap of the present invention. Locking strap 30 includes a locking strap similar to that shown in FIGS. 1 and 2. Locking strap 30 however possesses resilient finger grasps 32 which are used in order to facilitate the assembly process. Finger grasps 32 are flexible cantilevered tabs which extend laterally outwardly from opposed sidewalls 34 and 36. As can be seen in FIG. 4, flexible tabs 32 lie substantially within the height of the strap defined by first planar surface 38 and opposed second planar surface 40. Similar to the finger grasp of FIGS. 1 and 2, the resilient finger grasps 32 of FIG. 3 resiliently deform during insertion through head passage 42. During insertion through the head passage, resilient finger grasps 32 are pressed against sidewalls 36 and 34. After insertion, resilient finger grasps 32 return to their previous shape and allow grasping thereafter to facilitate assembly of the locking strap.

Figure 6:
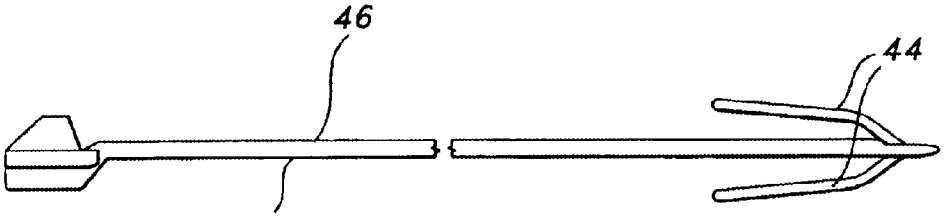
FIG. 6 is a side elevational view of the locking strap of FIG. 5.
Figure 5:
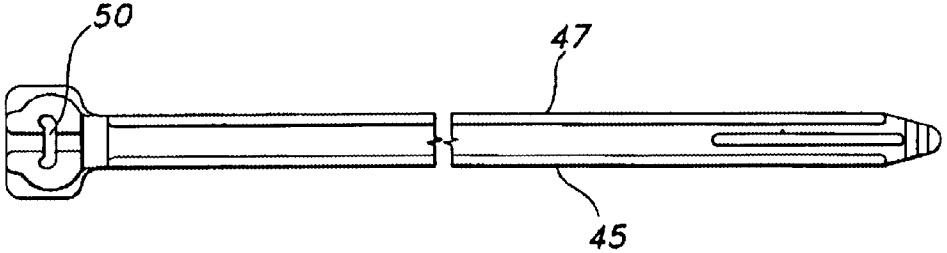
FIG. 5 is a top plan view of yet another embodiment of the locking strap of the present invention.

FIGS. 5 and 6 show another embodiment of the locking strap of the present invention. A resilient finger grasp is shown in the form of flexible cantilevered tabs 44. The flexible tabs 44 extend exteriorly above and below first and second opposed planar surfaces 46 and 48 and lie substantially within the width of the strap defined by opposed sidewalls 45 and 47. Consistent with the other embodiments of the present invention, flexible tabs 44 are resiliently deformed during insertion through head passage 50, in that flexible tabs are pressed against first and second planar surfaces 46 and 48. After insertion flexible tabs 44 resume their original shape to allow grasping thereafter to facilitate the assembly process.

Figure 7:
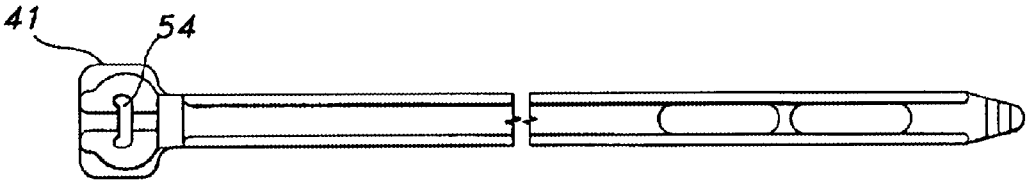
FIG. 7 is a top plan view of a further embodiment of the locking strap of the present invention.
Figure 8:
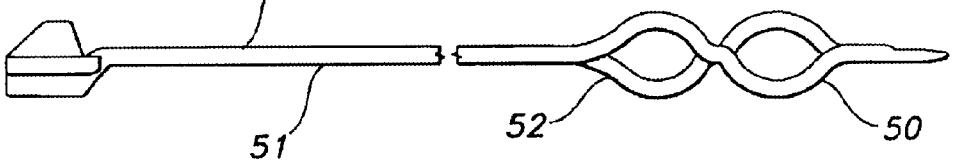
FIG. 8 is a side elevational view of the locking strap of FIG. 7.

The locking strap shown in FIGS. 7 and 8 is still another embodiment of the locking strap of the present invention. A first resilient finger grasp 50 and a second resilient finger grasp 52 are shown. Resilient finger grasps 50 and 52 interrupt the first and second planar surfaces 49, 51 to form loops for ease of grasping. Grasps 50 and 52 are constructed to resiliently deform when passed through a passage in head 54. The resilient deformation typically involves compression of the grasps 50 and 52 to a position substantially coplanar with opposed planar surfaces 49 and 51. A gripping flange 41 is also shown in FIGS. 7 and 8. Gripping flange 41 is a continuous strap attached on either side of the head of the locking strap and further facilitates assembly of the locking strap by providing a further structure to grip and facilitate assembly.

Figure 9:
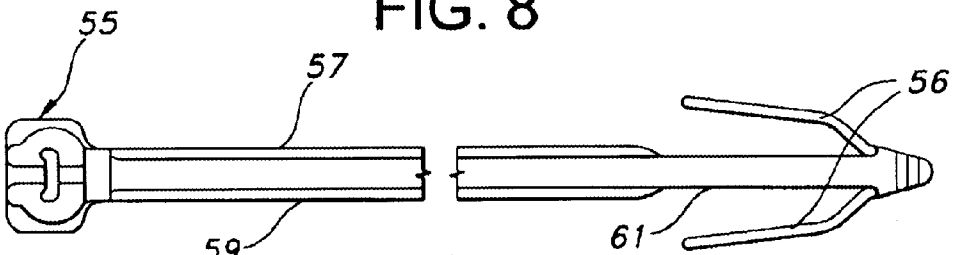
FIG. 9 is a top plan view of yet a further embodiment of the locking strap of the present invention.
Figure 10:
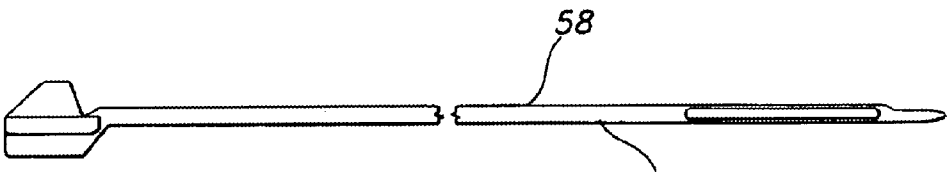
FIG. 10 is a side elevational view of the locking strap of FIG. 9.

The locking strap 55 of FIGS. 9 and 10 shows yet a further embodiment of the present invention. Locking strap 55 includes flexible tabs 56 similar to flexible tabs 44 depicted in FIG. 5. Flexible tabs 56, however, extend laterally exteriorly of transverse sidewalls 57, 59, and lie substantially within the height of the strap defined by first and second planar surfaces 58 and 60 as shown in the side elevational view of FIG. 10. Locking strap 55 additionally contains indented portions 53, 61 in transverse sidewalls 57, 59 to accommodate flexible tabs 56. When flexible tabs 56 are resiliently deformed during insertion through the head passage, indented portions 53, 61 provide a space to accommodate the flexible tabs 56 such that tabs 56 lie substantially coincident with or laterally within the planar surfaces of transverse sidewalls 57, 59.

While the preferred embodiments of the invention have been described herein, those skilled in the art will realize that changes and modifications may be made thereto without departing from the scope of the invention. The true scope of the invention is set forth in the claims appended hereto.

What is claimed is:

1. A flexible locking strap for tightening around one or more articles, comprising:

an elongate member having a head at one end, a tail at the other end and a central flexible strap body therebetween, said head having a passage therethrough for receipt of said tail; said strap further comprising a first planar surface and a second opposed planar surface, wherein said first and second planar surfaces are connected by transverse sidewalls which form planes substantially parallel to each other;

said head and said body including cooperative locking members for locking said body within said head passage; and a first and second flexible pulling tabs located between said tail and said central strap body, said flexible tabs being in cantilever attachment with said first and second planar surfaces respectively, and adapted for pulling said strap body through said head passage.

2. A locking strap according to claim 1 wherein said first and second flexible tabs are in cantilever attachment to said transverse sidewalls.

3. A locking strap according to claim 2 wherein said transverse sidewalls contain indented portions to accommodate said first and second flexible tabs.

* * * * *